US009073184B2

(12) United States Patent
Chen et al.

(10) Patent No.: US 9,073,184 B2
(45) Date of Patent: Jul. 7, 2015

(54) CONTROLLING STRUCTURE FOR A UNIDIRECTIONAL RATCHET WRENCH

(71) Applicants: Yu Wen Chen, Taichung (TW); Tien Sung Chen, Taichung (TW)

(72) Inventors: Yu Wen Chen, Taichung (TW); Tien Sung Chen, Taichung (TW)

(73) Assignee: YUNG FONG TOOLS CO., LTD., Taichung (TW)

( * ) Notice: Subject to any disclaimer, the term of this patent is extended or adjusted under 35 U.S.C. 154(b) by 227 days.

(21) Appl. No.: 13/740,290

(22) Filed: Jan. 14, 2013

(65) Prior Publication Data

US 2014/0196576 A1 Jul. 17, 2014

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
CPC ..... B25B 13/04; B25B 13/46; B25B 13/463
USPC ..... 81/60–63.2
See application file for complete search history.

(56) References Cited

U.S. PATENT DOCUMENTS

2003/0213342 A1* 11/2003 Wu ..... 81/60
2006/0027049 A1* 2/2006 Arnold ..... 81/60
2011/0100165 A1* 5/2011 Lee et al. ..... 81/60

* cited by examiner

*Primary Examiner* — Hadi Shakeri

(57) ABSTRACT

A controlling structure for a unidirectional ratchet wrench contains a driving head of a unidirectional ratchet wrench, and driving head having a receiving cavity and a groove communicating with the receiving cavity. The receiving cavity has a driving member, and the driving member has a toothed portion. The groove has a retaining block received therein, and the retaining block has a plurality of locking teeth so as to engage with the toothed portion. The retaining block has a slot or a tab so as to retain with the elastic member. The elastic member has a fitting segment, a curved section, and an abutting segment, the fitting segment is fitted into the slot or is retained with the tab, the curved section extends outwardly from the fitting segment and becomes curved, and the abutting segment connects with the curved section and abuts against the groove.

4 Claims, 7 Drawing Sheets

Prior Art

CONTROLLING STRUCTURE FOR A UNIDIRECTIONAL RATCHET WRENCH

FIELD OF THE INVENTION

The present invention relates to a unidirectional ratchet wrench, and more particularly to a controlling structure for the unidirectional ratchet wrench.

BACKGROUND OF THE INVENTION

As shown in FIG. 7, a conventional unidirectional ratchet wrench contains a driving head 40, the driving head 40 has a driving member 41 and a toothed portion 42 for retaining with a retaining block 44 of a groove 43, and the groove 43 has a hole 47 defined therein and having a returning spring 46 fixed in the hole 47. One end of the returning spring 46 abuts against a connecting extension 45 of the retaining block 44, such that the returning spring 46 presses the retaining block 44 to move inwardly so as to form a space, such that when an operational direction of the unidirectional ratchet wrench is identical to an arrangement direction of the retaining block 44, the retaining member 44 rotates a workpiece in a single direction.

However, the returning spring 46 is fatigued after a long period of using time, so it disengages from the hole 47 or from the connecting extension 45, In addition, the hole 47 has to be drilled, thus increasing production cost.

The present invention has arisen to mitigate and/or obviate the afore-described disadvantages.

SUMMARY OF THE INVENTION

The primary object of the present invention is to provide a controlling structure for the unidirectional ratchet wrench in which the retaining block presses the elastic member so as to form an inward retracted space, thus rotating the unidirectional ratchet wrench smoothly and easily.

To obtain the above objectives, a controlling structure for a unidirectional ratchet wrench provided by the present invention contains:

a driving head of an unidirectional ratchet wrench, and the driving head including a receiving cavity defined in a front end thereof and a groove formed in a rear end thereof and communicating with the receiving cavity;

the receiving cavity having a driving member received therein, and the driving member having a toothed portion arranged around an outer wall thereof;

the groove having a retaining block received therein, and the retaining block having a plurality of locking teeth formed on a front end thereof so as to engage with the toothed portion of the driving member; the retaining block having a slot defined therein or a tab extending outwardly therefrom so as to retain with the elastic member;

wherein the elastic member has a fitting segment, a curved section, and an abutting segment, the fitting segment is fitted into the slot of the retaining block or is retained with the tab, the curved section extends outwardly from the fitting segment and becomes curved, and the abutting segment connects with the curved section and abuts against the groove.

DETAILED DESCRIPTION OF THE PREFERRED EMBODIMENTS

Figure 1:
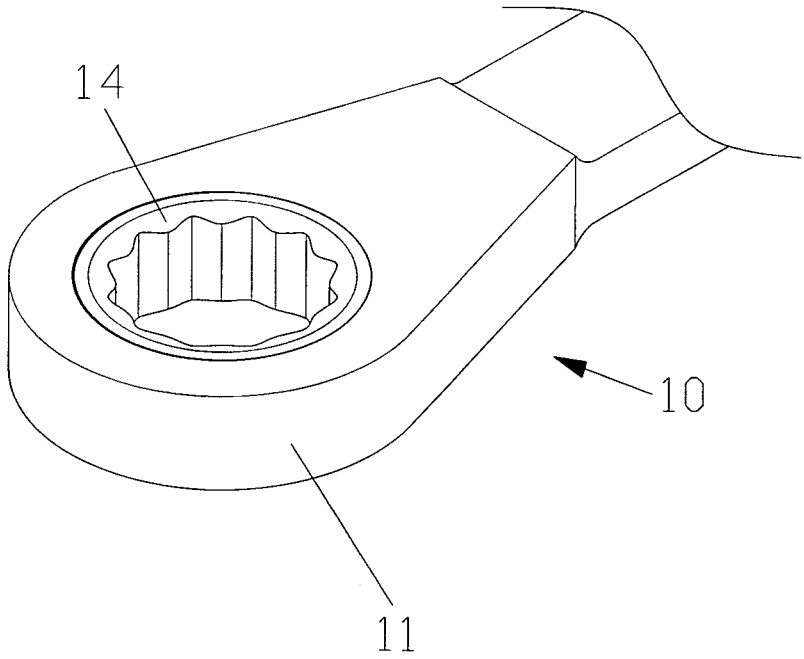
FIG. 1 is a perspective view showing the assembly of a controlling structure for a unidirectional ratchet wrench according to a first embodiment of the present invention.
Figure 2:
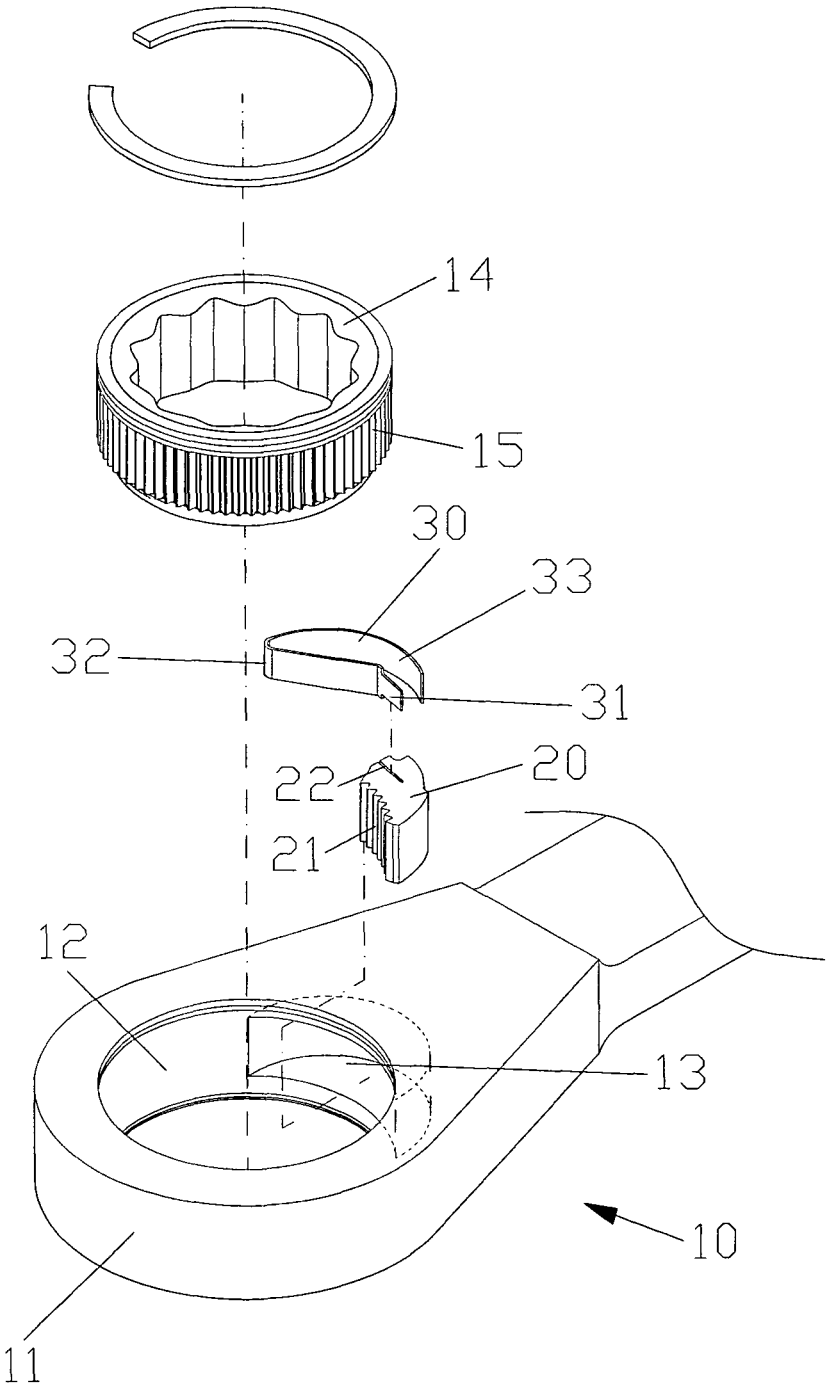
FIG. 2 is a perspective view showing the exploded components of the controlling structure for the unidirectional ratchet wrench according to the first embodiment of the present invention.

Referring to FIGS. 1-2, a controlling structure for an unidirectional ratchet wrench according to a first embodiment of the present invention comprises: a driving head 11 of a unidirectional ratchet wrench 10, and the driving head 11 includes a receiving cavity 12 defined in a front end thereof and a groove 13 formed in a rear end of thereof and communicating with the receiving cavity 12. The receiving cavity 12 has a driving member 14 received therein, and the driving member 14 has a toothed portion 15 arranged around an outer wall thereof. The groove 13 has a retaining block 20 received therein, and the retaining block 20 has a plurality of locking teeth 21 formed on a front end thereof so as to engage with the toothed portion 15 of the driving member 14. The retaining block 20 has a slot 22 defined therein, and the slot 22 has an elastic member 30 retained therein. The elastic member 30 is integrally formed and has a fitting segment 31, a curved section 32, and an abutting segment 33, wherein the fitting segment 31 is fitted into the slot 22 of the retaining block 20, the curved section 32 extends outwardly from the fitting segment 31 and becomes curved, and the abutting segment 33 connects with the curved section 32 and abuts against the groove 13, such that the elastic member 30 is formed in a C shape.

Figure 3:
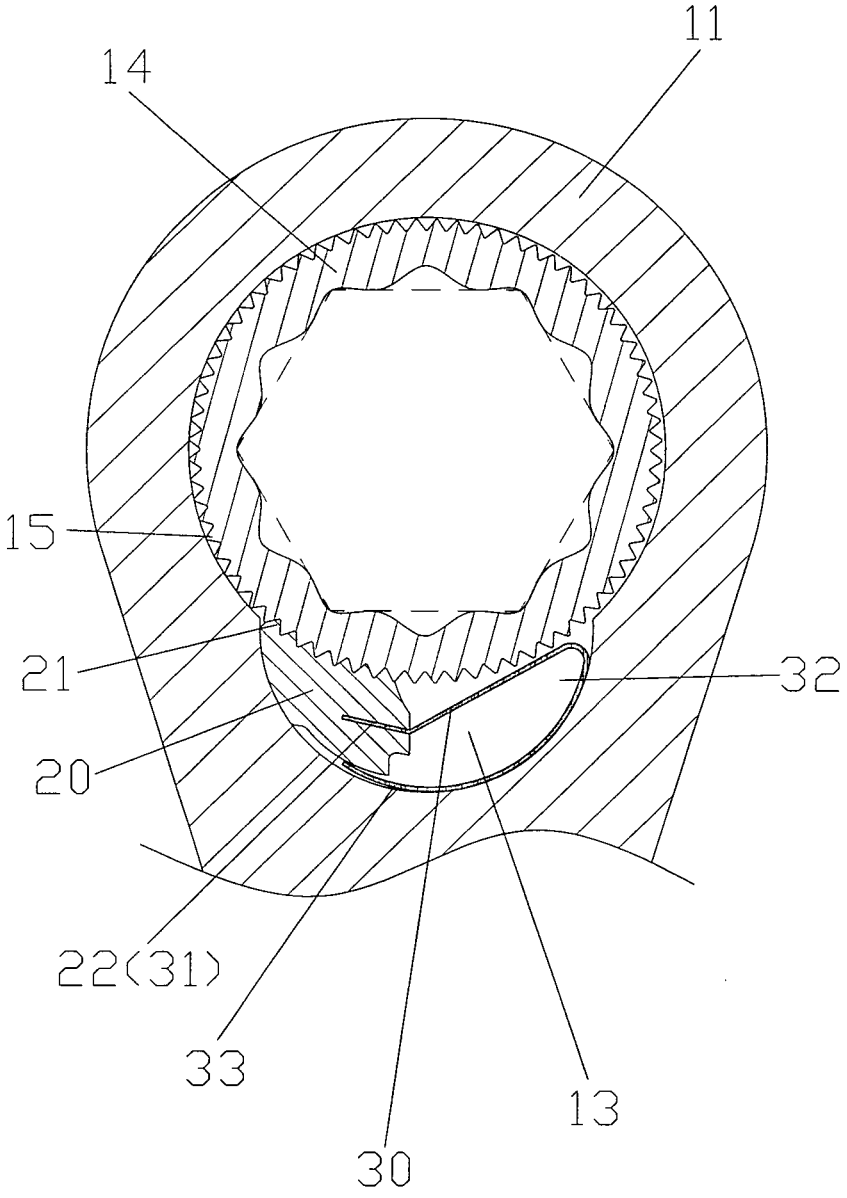
FIG. 3 is a cross sectional view showing the operation of the controlling structure for the unidirectional ratchet wrench according to the first embodiment of the present invention.
Figure 4:
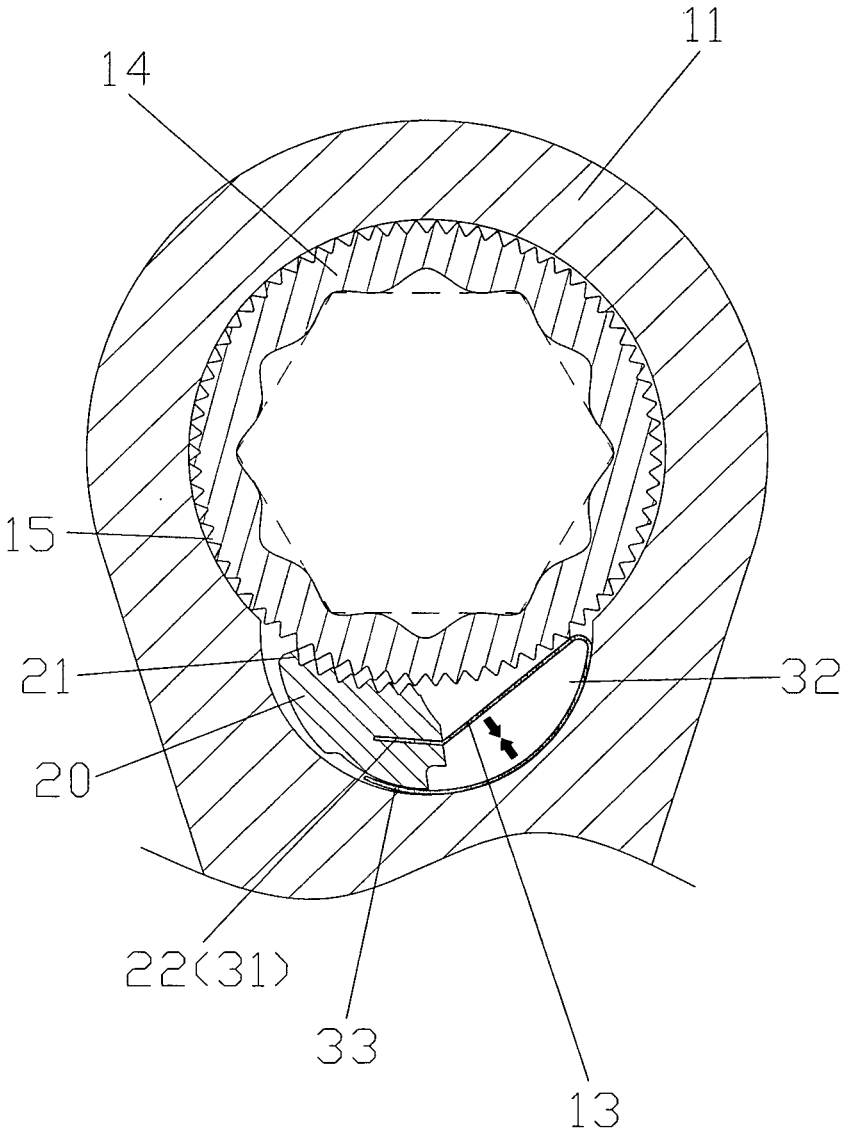
FIG. 4 is another cross sectional view showing the operation of the controlling structure for the unidirectional ratchet wrench according to the first embodiment of the present invention.

Referring further to FIGS. 3 and 4, if an operational direction of the unidirectional ratchet wrench 10 is opposite to an arrangement direction of the retaining block 20, and the plurality of locking teeth 21 of the retaining block 20 retain with the toothed portion 15 of the driving member 14 so that the unidirectional ratchet wrench 10 rotates a workpiece. On the contrary, if the operational direction of the unidirectional ratchet wrench 10 is identical to the arrangement direction of the retaining block 20, the retaining block 20 presses the elastic member 30 so as to form an inward retracted space, thus rotating the unidirectional ratchet wrench 10 smoothly and easily.

Figure 5:
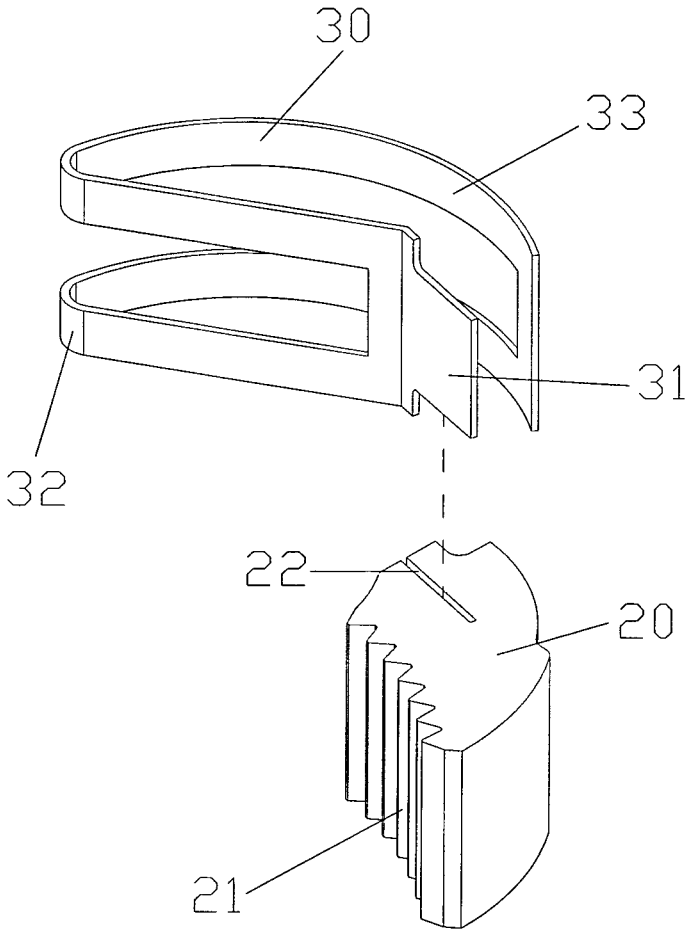
FIG. 5 is a perspective view showing the exploded components of an elastic member of a controlling structure for a unidirectional ratchet wrench according to a second embodiment of the present invention.

As shown in FIG. 2, the elastic member 30 of the first embodiment is a solid elastic block. As illustrated in FIG. 5, an elastic member 30 of a second embodiment is a hollow elastic piece.

Figure 6:
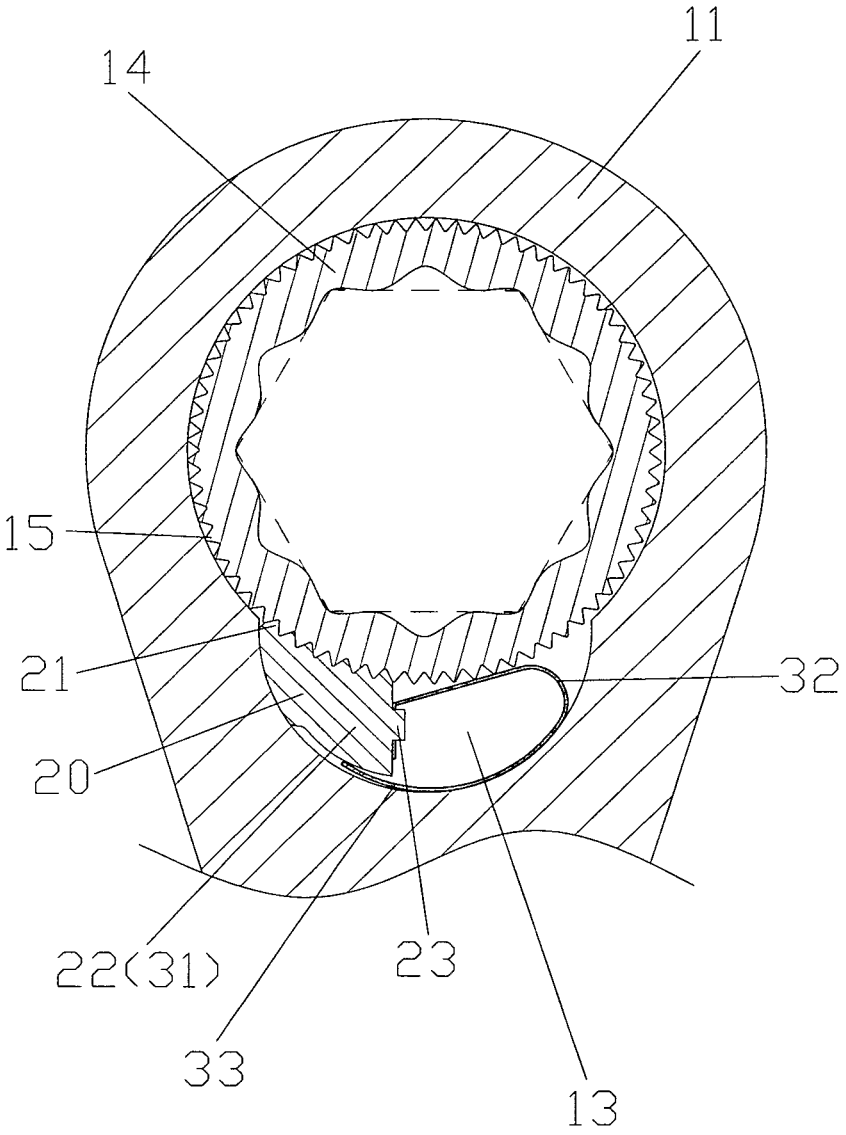
FIG. 6 is a cross sectional view showing the assembly of a controlling structure for a unidirectional ratchet wrench according to a third embodiment of the present invention.
Figure 7:
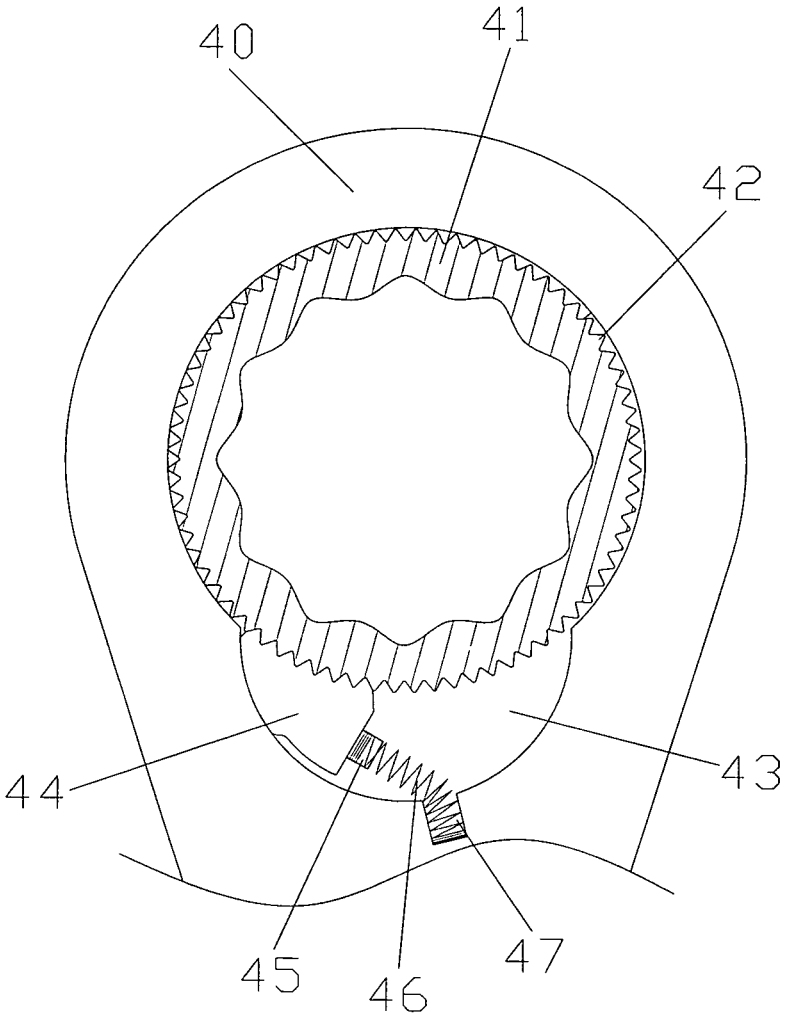
FIG. 7 is a cross sectional view showing a conventional unidirectional ratchet wrench.

Referring further to FIG. 6, a retaining block 20 of a third embodiment has a tab 23 extending outwardly therefrom so as to retain with the elastic member 30.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A controlling structure for a unidirectional ratchet wrench comprising:

a driving head of an unidirectional ratchet wrench, and the driving head including a receiving cavity defined in a front end thereof and a groove formed in a rear end thereof and communicating with the receiving cavity;

the receiving cavity having a driving member received therein, and the driving member having a toothed portion arranged around an outer wall thereof;

the groove having a retaining block received therein, and the retaining block having a plurality of locking teeth formed on a front end thereof so as to engage with the toothed portion of the driving member; the retaining block having a slot defined therein so as to retain with an elastic member and a recess formed on a rear end thereof;

wherein the elastic member has a fitting segment, a curved section, an abutting segment, and a free end, the fitting segment is fitted into the slot of the retaining block, the curved section extends outwardly from the fitting segment and becomes curved, and the abutting segment connects with the curved section and abuts against a rear peripheral side of the groove, and the free end of the elastic member is positioned against the recess of the rear end of the retaining block;

wherein a part of the elastic member between the fitting segment and the curved section of the elastic member is biased against the toothed portion of the driving member.

2. The controlling structure for the unidirectional ratchet wrench as claimed in claim 1, wherein the elastic member is integrally formed.

3. The controlling structure for the unidirectional ratchet wrench as claimed in claim 1, wherein the elastic member is a solid elastic block or a hollow elastic piece.

4. The controlling structure for the unidirectional ratchet wrench as claimed in claim 1, wherein the elastic member is formed in a C shape.

* * * * *